US005390495A

United States Patent [19]

Lemaire

[11] Patent Number: 5,390,495

[45] Date of Patent: Feb. 21, 1995

[54] ASSEMBLY OF A HYDRAULIC MOTOR AND OF A BRAKE AND COMPACTOR APPLYING SAME

[75] Inventor: Gilles G. Lemaire, Margny Les Compiegne, France

[73] Assignee: Poclain Hydraulics, Verberte Cedex, France

[21] Appl. No.: 865,322

[22] Filed: Apr. 8, 1992

[30] Foreign Application Priority Data

Apr. 15, 1991 [FR] France ..... 91 04596

[51] Int. Cl.[6] ..... F01K 1/04

[52] U.S. Cl. ..... 60/442; 92/17; 404/117; 404/132

[58] Field of Search ..... 60/435, 442; 92/17; 188/71.5; 404/117, 130, 132

[56] References Cited

U.S. PATENT DOCUMENTS

| | | | |
|---|---|---|---|
| 3,865,207 | 2/1975 | Schwab et al. . | |
| 4,089,616 | 5/1978 | Fairchild et al. | 404/132 |
| 4,398,843 | 8/1983 | Bloom, Jr. | 404/117 |
| 4,568,212 | 2/1986 | Orzal | 404/117 |
| 4,732,507 | 3/1988 | Artzberger | 404/117 |
| 4,793,735 | 12/1988 | Paukert | 404/132 |
| 5,082,396 | 1/1992 | Polacek | 404/117 |

FOREIGN PATENT DOCUMENTS

| | | | |
|---|---|---|---|
| 233057 | 6/1977 | France . | |
| 2541636 | 8/1984 | France . | |
| 1559276 | 1/1980 | United Kingdom . | |
| 2123502 | 2/1984 | United Kingdom | 188/71.5 |
| 2172677 | 9/1986 | United Kingdom | 188/71.5 |
| 2209142 | 5/1989 | United Kingdom . | |

OTHER PUBLICATIONS

Creamer, R. H., *Machine Design*. Addison-Wesley Publishing, 1976. pp. 113-115.

*Primary Examiner*—Edward K. Look
*Assistant Examiner*—F. Daniel Lopez
*Attorney, Agent, or Firm*—James A. Drobile; Robert E. Rosenthal

[57] ABSTRACT

This invention relates to an assembly of a hydraulic motor and of a brake which is coupled thereto, comprising in particular a brake shaft which traverses said motor and brake entirely. According to the invention, the brake shaft comprises an axial through recess allowing passage of a link, such as a movement transmission shaft. One application of the invention is the production of a reliable compactor.

6 Claims, 2 Drawing Sheets

ASSEMBLY OF A HYDRAULIC MOTOR AND OF A BRAKE AND COMPACTOR APPLYING SAME

FIELD OF THE INVENTION

The present invention relates to a hydraulic motor and brake assembly and to a compactor incorporating same.

BACKGROUND OF THE INVENTION

The invention originates in the search for a solution to the problem of driving the compaction rollers of a compactor.

According to a first known embodiment, the compactor comprises a single compaction roller which is mounted to rotate with respect to the frame of the compactor with the interposition of supple vibration-damping elements. A hydraulic motor, generally with low speed of rotation and high torque, is coupled to the compaction roller and ensures drive thereof, being placed at one end of and coaxial to said compaction roller.

In order to improve the efficiency of compaction, an eccentric mass is placed in the hollow interior of the compaction roller, and is driven in rotation by means of another motor, generally constituted by a hydraulic motor with high speed and low torque. This other motor is placed at the other end of the compaction roller, coaxially thereto, and drives the eccentric mass via a shaft.

In order to improve the manoeuvrability of compactors, particularly in bends, certain compactors comprise two coaxial compaction rollers in line with each other and coupled to two distinct hydraulic motors. In this way, the rollers may have different rotations, which makes it possible to avoid the destruction of the compacted ground. On the side where the motor for driving the eccentric mass is already placed, it is not possible to couple the motor driving the corresponding compaction roller directly to this compaction roller. The known solution consists in moving said motor driving the compaction roller out of centre; in placing it where there is room, i.e. next to the motor for driving the eccentric mass; and in coupling the drive shaft of the motor driving the compaction roller to said compaction roller via a ring gear and gear pinions. The assembly is complex, cumbersome, heavy and expensive.

It is an object of the invention to overcome these drawbacks by proposing a solution where the two motors located on the same side of one of the compaction rollers are disposed coaxially to each other and to this compaction roller. To that end, it was necessary to study a novel hydraulic motor before applying it to compactors, such hydraulic motor being provided with a brake.

SUMMARY OF THE INVENTION

The invention therefore relates firstly to an assembly of a hydraulic motor and of a brake which is coupled thereto, comprising: a central motor element traversed by a first axial recess; a peripheral motor element mounted for relative rotation with respect to said central motor element about an axis; and a brake shaft which is fast, with respect to said relative rotation, with said central motor element and which axially extends concomittantly opposite the central motor element and opposite the brake.

According to the invention: a) the brake comprises a housing of which at least a part is fast with the peripheral element of the motor, and which itself comprises a bottom disposed transversely with respect to the axis; b) the bottom comprises a through bore; c) the brake shaft completely traverses the motor/brake assembly, in particular said bore in the bottom of the brake housing; d) two O-rings are interposed between the brake shaft and, on the one hand, the first recess of the central element of the motor and, on the other hand, said bore in the bottom of the brake housing, respectively; e) the brake shaft comprises a second recess traversing it completely.

The following advantageous arrangements are in addition preferably adopted:

- the brake housing comprises a peripheral part which is fast with the peripheral element of the motor, and a closure lid, distinct from said peripheral part and constituting said bottom;
- an adaptation flange is fixed on the peripheral part of the brake housing, whilst said brake housing lid constitutes, in addition, a member for pushing braking members that the brake comprises, an elastic return member being interposed between the brake housing lid and said adaptation flange.

The invention also relates to a compactor which comprises at least one assembly according to one of the preceding definitions.

According to the invention, this compactor comprises at least one assembly of a hydraulic motor and a brake in accordance with the preceding definitions and further comprises: two distinct cylindrical compaction rollers mounted to rotate about a common geometrical axis; two principal hydraulic motors for driving said rollers coupled between the frame of the compactor and one of the principal hydraulic motors, one of said compaction rollers, the other principal hydraulic motor, the other compaction roller, a first of said principal hydraulic motors forming part of an assembly according to one of the preceding definitions; an eccentric mass with respect to said geometrical axis; and a third motor for driving said eccentric mass, coupled between the frame of the compactor and said mass, and comprising two-elements mounted for relative rotation with respect to each other; whilst, on the one hand, a first of said elements of the third motor is rendered fast, with respect to rotation, with the peripheral element of the first principal hydraulic motor, on the other hand, the second of said two elements of the third motor is rendered East, with respect to rotation, with a shaft which traverses the second recess made in the brake shaft of the brake belonging to said assembly of which said first principal hydraulic motor forms part.

The following advantageous arrangements are, in addition, preferably adopted:

- said first element of the third motor is rendered fast, with respect to rotation, with the peripheral element of the first principal hydraulic motor by means of an intermediate flange, distinct from said third motor and first principal hydraulic motor;
- an adaptation flange is fixed on the peripheral part of the brake housing, whilst said brake housing lid further constitutes a member for pushing braking members that the brake comprises, an elastic return member being interposed between the brake housing lid and said adaptation flange, the intermediate flange being constituted by said adaptation flange.

The principal advantage of the invention resides in the fact that the axial recess made in the brake shaft allows the passage of a drive shaft connecting the eccentric mass to its drive motor, whilst making it possible to place the hydraulic motor for driving the compaction roller coaxially to said compaction roller and thus to drive this compaction roller directly.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
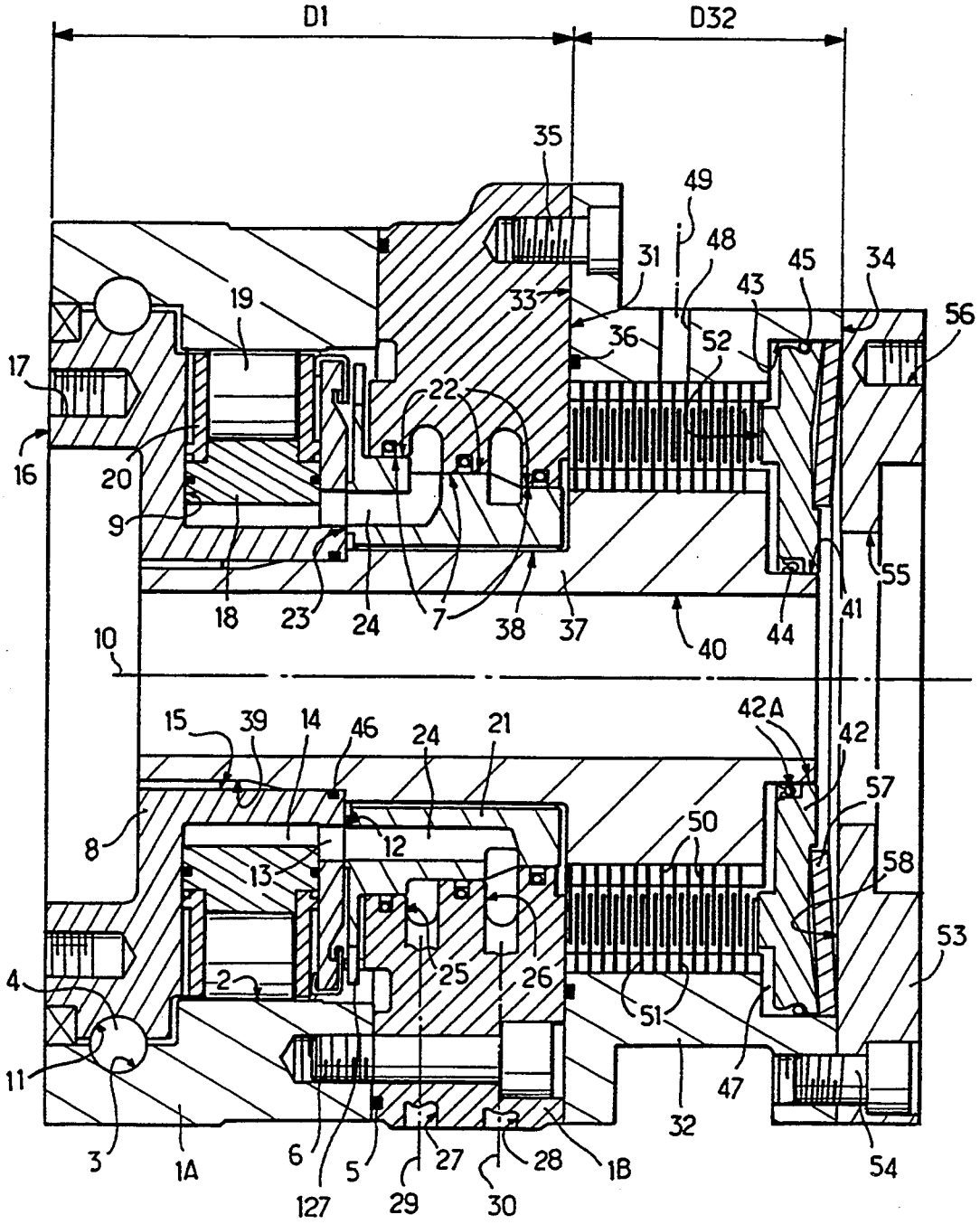
FIG. 1 is an axial section through an assembly, according to the invention, of a hydraulic motor and of a brake coupled thereto.
Figure 2:
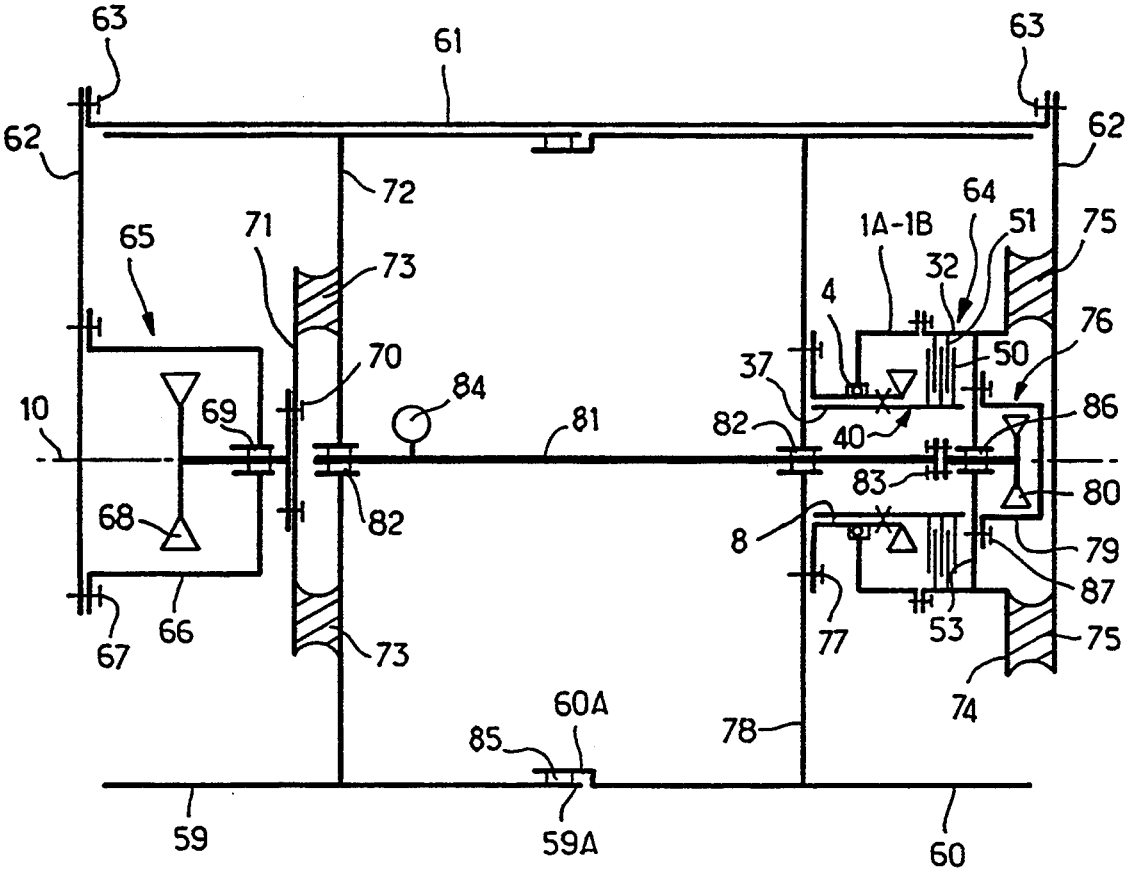
FIG. 2 is a schematic section through a compactor roller and of the brake motors for driving it.

Referring now to the drawings, the motor shown in FIG. 1 is a hydraulic motor associated with a multi-disc brake, the assembly comprising:

a peripheral motor element, in two parts 1A and 1B, part 1A presenting an inner face constituting a lobed reaction cam 2, extended axially, with respect to an axis 10, by the support 3 of a single ball bearing 4, and part 1B, assembled with part 1A, with the inter-position of an O-ring 5, by screws 6, comprising a stepped bore 7;

a central motor element 8, which constitutes the cylinder-block of the hydraulic motor, in which are formed cylinders 9 disposed radially with respect to axis 10 and regularly spaced apart angularly, this central element comprising the support 11, complementary to support 3 and making therewith and the balls 4 a bearing for rotation of axis 10; a plane face 12 for communication in which open out cylinder conduits 13 connected to fluid-working chambers 14 made in the cylinders 9, said plane face perpendicular to axis 10; splines 15 with which a bore of the cylinder-block 8 is provided, coaxial to axis 10; and a transverse face 16 which constitutes a first axial end of the hydraulic motor/brake assembly, in which open out tappings 17 allowing the fixation of the cylinder-block 8, for example on a transverse web 78 with which one, 60, of the rollers 59, 60 of a compactor is provided (FIG. 2);

pistons 18 mounted to slide in the cylinders 9 and forming therewith said fluid-working chambers 14;

rollers 19 mounted at the outer ends of the pistons 18, one per piston, with axes parallel to axis 10, maintained axially by axial stops 20 and capable of being in bearing abutment on the reaction cam 2;

an internal fluid distributor valve 21 which constitutes a core whose outer axial face 22 is complementary of that of the stepped bore 7, this inner distributor valve 21 comprising: a plane face 23 for distribution, perpendicular to axis 10 and in substantially tight abutment on the communication face 12 of the cylinder-block 8; distribution conduits 24 which open out in the distribution face 23 so as to be able to communicate with the orifices of the cylinder conduits 13 via which the latter open out in the communication face 12, and which connect said distribution face 23 to grooves 25, 26 made in the stepped bore 7 of part 1B of the peripheral motor element; an assembly of studs and notches 127 effecting connection, with respect to rotation about axis 10, of the inner distributor valve 21 and said part 1B; and a transverse face 31 perpendicular to axis 10, which constitutes the other axial end of the hydraulic motor, which therefore extends axially over a length D1;

conduits 27, 28 made in part 1B of the peripheral element 1A–1B, connecting said grooves 25, 26 to outer conduits 29, 30 respectively, the latter constituting, one, a pressurized fluid supply conduit, the other, a fluid exhaust conduit, and vice versa;

a peripheral brake housing part 32 which comprises two transverse faces 33, 34 perpendicular to axis 10 and therefore extends axially over a length D32, the transverse face 33 being placed in abutment on the end face 31 of part 1B, with the interposition of an 0-ring 36 and the peripheral part 32 of the brake housing being fixed on said part 1B of the hydraulic motor by screws 35;

a brake shaft 37 which extends coaxially to axis 10, opposite the splines 15 of the cylinder-block 8, a bore 38 that the inner distributor valve 21 comprises, and the peripheral part 32 of the brake housing, to a large extent over the lengths D1 and D32; this brake shaft comprising splines 39 which cooperate with splines 15 of the cylinder-block 8 in order to render fast, with respect to rotation about axis 10, the cylinder-block 8 and the brake shaft 37; an axial recess 40, traversing said brake shaft 37 entirely and, in the present case, coaxial to axis 10; and a cylindrical end bearing surface 41;

a brake housing lid 42 comprising a through bore 42A, mounted to slide, parallel to axis 10, with respect to the cylindrical bearing surface 41 and with respect to a bore 43 that the peripheral part 32 of the brake housing comprises;

O-rings 44, 45, 46: 0-ring 44 being interposed between the bore 42A of the lid 42 and the cylindrical bearing surface 41; 0-ring 45 being interposed between the lid 42 and the bore 43; and 0-ring 46 being interposed between the brake shaft 37 and the axial bore of the cylinder-block 8, the assembly of the brake shaft 37, of the peripheral part 32 of the brake housing and of the lid 42 defining a tight chamber 47;

a conduit 48, made in the peripheral part 32 of the brake housing, connecting chamber 47 to an outer conduit 49 capable of containing a fluid under pressure or, on the contrary, of being placed in communication with a tank of fluid without pressure;

brake discs fast, with respect to rotation, brake discs 50, with the brake shaft 37, brake discs 51 with the peripheral part 32 of the brake housing, the brake discs 50, 51 being alternate and constituting a stack of brake discs disposed opposite a transverse thrust face 52, belonging to the lid 42;

an adaptation flange 53, which is fixed on the peripheral part 32 of the brake housing by screws 54, being placed in abutment on the end face 34 of said peripheral part 32, this adaptation flange 53 presenting an axial bore 55, of axis 10, and tappings 56 allowing fixation of a structure such as the housing 79 of another hydraulic motor 76;

an elastic washer 57 abuts on the inner transverse face 58 of the adaptation flange 53 and tends 52 of this lid in abutment on the end of the stack of discs 50, 51, i.e. in the sense of braking, the action of the washer 57 being antagonistic of that of the pressure of the fluid possibly contained in the chamber 47, which allows loosening of the brake discs 50, 51 to be obtained.

It should be observed that the brake shaft 37 traverses the motor entirely, in particular its cylinder block 8 and its internal fluid distributor valve 21, and the brake, including the lid 42 of its housing (32–42). Moreover, as the axial recess 40 itself traverses the brake shaft 37 entirely, it is possible to pass a link, such as a movement transmission shaft, through the motor/brake assembly, passing through the axial recess 40, as is described in the example of application shown in FIG. 2.

FIG. 2 schematically shows the two cylindrical compaction rollers 59, 60 of a compactor.

This compactor comprises:

a frame 61;

two lateral arms 62 fixed (63) on the frame 61;

two principal hydraulic motors 64, 65, one of them, 64, belonging to the assembly described with regard to FIG. 1;

the housing 66 of the hydraulic motor 65, constituting its stator, is fixed (67) on one of the lateral arms 62, whilst the rotor 68 of the hydraulic motor 65, mounted to rotate with respect to the stator by means of a bearing 69, is rendered fast (70), with respect to a rotation about axis 10, with a plate 71 connected to a transverse web 72 that the compaction roller 59 comprises via elastic vibration-insulating studs 73;

the motor 64, of which the peripheral element 1A-1B comprises a plate 74 connected to the second lateral arm 62 via elastic studs 75, and whose central element 8 is fixed (77) on a transverse web 78 that the compaction roller 60 comprises;

a third motor 76 has its stator 79 fixed (87) on the adaptation flange 53, therefore constituting an intermediate flange between the peripheral element 1A–1B of the motor 64 and said stator 79, and its rotor 80 is rendered fast (83), with respect to rotation, with a shaft 81 which extends inside the compaction rollers 59, 60, in particular between their transverse webs 72, 78, which support it via bearings 82, said stator 79 and rotor 80 being mounted for relative rotation by a bearing 86; and the shaft 81 traversing the assembly of motor 64 and of the brake which is coupled thereto, passing through the axial recess 40 of the brake shaft 37;

a mass 84, eccentric with respect to axis 10, is fast with shaft 81;

a bearing 85 is in addition interposed between the overlapping ends 59A, 60A of the two compaction rollers 50, 60.

The following observations should be made:

each of the three motors 64, 65 and 76 of FIG. 2 is mounted to rotate about the same axis 10;

the two compaction rollers 59, 60 are driven without any interposition of gear elements, in particular by direct fixation of rotor 68 on plate 70, of rotor 8 on web 78, and of rotor 80 on shaft 81;

in the motor 64, identical to that of FIG. 1, the central element 8 is constituted by the cylinder-block, the peripheral element 1A–1B constituting the housing: the arrangements of the invention would apply equally well to a motor whose peripheral element is constituted by a cylinder-block, the central element in that case being constituted by the cam;

in order to effect direct, therefore simple, drives, the hydraulic motors 64, 65 have been chosen from so-called low-speed/high-torque motors;

the motor 76 effectively adopted is a hydraulic motor with high speed and low torque; this motor is advantageously of the hydraulic type, as the supply circuit of the principal motors 64, 65 is not rendered much more complex by the provision of the fluid supply of a third motor 76; however, in a variant, the motor 76 may not be of hydraulic type (may, for example, be electric);

in FIG. 2, the brake 50, 51 and the brake shaft 37 of the assembly to which motor 64 belongs, have not been shown, but they do exist.

It may be observed that the axial recess 40 that the assembly of FIG. 1 comprises, allows the axial passage through the motor and the brake by any element, such as shaft 81 of FIG. 2, this element being able to be other than a drive shaft and, for example, in certain different applications, may be constituted by pipes or measuring instruments. The O-rings 44, 45, 46 ensure satisfactory functioning of the assembly, whilst the adaptation flange 53, which allows any third motor 76 to be adapted to drive shaft 81, in addition performs the starting function of bearing for the elastic washer 57.

The invention is not limited to the embodiment described, but covers, on the contrary, all variants which may be made thereof without departing from its scope nor spirit.

In particular, it is also applicable to assemblies in which the peripheral part 32 of the brake housing is monobloc with part 1B of the peripheral element of the motor housing, said assemblies naturally provided with a removable lid 42 (removable fixation via flange 53 and screws 54); and to assemblies in which the brake housing is monobloc (peripheral part 32 and lid 42 monobloc), fixed on part 1B of the motor housing by means of a removable fixation.

What is claimed is:

1. A compactor comprising at least one assembly of a hydraulic motor and of a brake which is coupled thereto, which assembly comprises:

a central motor element traversed by a first axial recess;

a peripheral motor element mounted for relative rotation with respect to said central motor element about an axis;

a brake shaft which is fast, with respect to said relative rotation, with said central motor element and which axially extends concomitantly along the central motor element and along the brake; wherein:

a) the brake comprises a housing of which at least a part is fast with the peripheral element of the motor, and which itself comprises a bottom disposed transversely with respect to the axis;

b) the bottom comprises a through bore;

c) the brake shaft completely traverses the motor/-brake assembly, in particular said bore in the bottom of the brake housing;

d) two O-rings are interposed between the brake shaft and, on the other hand, the first recess of the central element of the motor and, on the other hand, said bore in the bottom of the brake housing, respectively;

e) the brake shaft comprises a second recess traversing it completely;

wherein, said compactor further comprises:

two distinct cylindrical compaction rollers mounted to rotate about a common geometrical axis;

two principal hydraulic motors for driving said rollers, one of these two principal hydraulic motors being coupled between the frame of the compactor and one of said compaction rollers, the other principal hydraulic motor being coupled between the frame of the compactor and the other compaction roller, a first of said principal hydraulic motors forming part of said assembly an eccentric mass with respect to said geometrical axis;

a third motor for driving said eccentric mass, coupled between the frame of the compactor and said mass, and comprising two elements mounted for relative rotation with respect to each other; and wherein, on the one hand, a first of said elements of the third motor is rendered fast, with respect to rotation, with the peripheral element of the first principal hydraulic motor, on the other hand, the second of said two elements of the third motor is rendered fast, with respect to rotation, with a shaft which traverses the second recess made in the brake shaft of the brake belonging to said assembly of which said first principal hydraulic motor forms part.

2. The compactor of claim 1, wherein said first element of the third motor is rendered fast, with respect to rotation, with the peripheral element of the first principal hydraulic motor by means of an intermediate flange, distinct from said third motor and first principal hydraulic motor.

3. The compactor of claim 2, wherein the brake housing comprises a peripheral part which is fast with the peripheral element of the motor, and a closure lid, distinct from said peripheral part and constituting said bottom, and, wherein an adaptation flange is fixed on the peripheral part of the brake housing, whilst said closure lid further constitutes a member for pushing braking members that the brake comprises, an elastic return member being interposed between the closure lid and said adaptation flange, the intermediate flange being constituted by said adaptation flange.

4. A compactor comprising at least one assembly of a hydraulic motor and of a brake which is coupled thereto, which assembly comprises:

a central motor element traversed by a first axial recess;

a peripheral motor element mounted for relative rotation with respect to said central motor element about an axis;

a brake shaft which is fast, with respect to said relative rotation, with said central motor element and which axially extends concomitantly along with central motor element and along the brake; wherein:

a) the brake comprises a housing of which at least a part is fast with the peripheral element of the motor, and which itself comprises a bottom disposed transversely with respect to the axis;

b) the bottom comprises a through bore;

c) the brake shaft completely traverses the motor/-brake assembly, in particular said bore in the bottom of the brake housing;

d) two O-rings are interposed between the brake shaft and, on the one hand, the first recess of the central element of the motor and, on the other hand, said bore in the bottom of the brake housing, respectively;

e) the brake shaft comprises a second recess traversing it completely; wherein the brake housing comprises a peripheral part which is fast with the peripheral element of the motor, and a closure lid, distinct from said peripheral part and constituting said bottom; wherein an adaptation flange is fixed on the peripheral part of the brake housing, whilst said closure lid constitutes, in addition, a member for pushing braking members that the brake comprises, an elastic return member being interposed between the closure lid and said adaptation flange; and wherein said compactor further comprises:

two distinct cylindrical compaction rollers mounted to rotate about a common geometrical axis;

two principal hydraulic motors for driving said rollers, one of these two principal hydraulic motors being coupled between the frame of the compactor and one of said compaction rollers, the other principal hydraulic motor being coupled between the frame of the compactor and the other compaction roller, a first of said principal hydraulic motors forming part of said assembly;

an eccentric mass with respect to said geometrical axis; and a third motor for driving said eccentric mass, coupled between the frame of the compactor and said mass, and comprising two elements mounted for relative rotation with respect to each other; and wherein, on the one hand, a first of said elements of the third motor is rendered fast, with respect to rotation, with the peripheral element of the first principal hydraulic motor, on the other hand, the second of said two elements of the third motor is rendered fast, with respect to rotation, with a shaft which traverses the second recess made in the brake shaft of the brake belonging to said assembly of which said first principal hydraulic motor forms part.

5. The compactor of claim 4, wherein said first element of the third motor is rendered fast, with respect to rotation, with the peripheral element of the first principal hydraulic motor by means of an intermediate flange, distinct from said third motor and first principal hydraulic motor.

6. The compactor of claim 5, wherein said intermediate flange is constituted by said adaption flange.

* * * * *